US005437451A

United States Patent [19]

Fulton

[11] Patent Number: 5,437,451

[45] Date of Patent: Aug. 1, 1995

[54] DRAW STUD POKER-TYPE CARD GAME

[75] Inventor: Stanley E. Fulton, Las Vegas, Nev.

[73] Assignee: DD Stud, Inc., Las Vegas, Nev.

[21] Appl. No.: 130,646

[22] Filed: Oct. 1, 1993

[51] Int. Cl.[6] ..... A63F 9/00

[52] U.S. Cl. ..... 273/138 A; 273/85 CP; 273/292; 364/412

[58] Field of Search ..... 273/138 A, 85 CP, 85 G, 273/138 R, 292; 364/412

[56] References Cited

U.S. PATENT DOCUMENTS

| | | | |
|---|---|---|---|
| 5,019,973 | 5/1991 | Wilcox et al. | 364/412 |
| 5,033,744 | 7/1991 | Bridgeman et al. | 273/85 CP |
| 5,042,818 | 8/1991 | Weingardt | 273/292 |
| 5,100,137 | 3/1992 | Fulton | 273/85 CP |
| 5,251,897 | 10/1993 | Fulton | 273/85 CP |
| 5,255,915 | 10/1993 | Miller | 273/85 CP |
| 5,294,120 | 3/1994 | Schultz | 273/85 CP |

*Primary Examiner*—Vincent Millin
*Assistant Examiner*—Kerry Owens
*Attorney, Agent, or Firm*—Galgano & Burke

[57] ABSTRACT

Methods and apparatus are provided in which a player may build a winning card hand. According to one method of playing a card game, a player is provided with sequential opportunities to build a winning hand comprising the steps of: providing a player with an opportunity to make a wager; providing a player with a first plurality of cards wherein one of said cards is first optional card; providing said player with the choice of keeping or discarding said first optional card; subsequently providing said player with a first replacement card if said player discarded said first optional card and providing said player with a second optional card; providing said player with the choice of keeping or discarding said second optional card; subsequently providing said player with a second replacement card if said player discarded said second optional card; and providing said player with a winning payout if said player's final hand favorably compares with a predetermined winning payout schedule.

19 Claims, 1 Drawing Sheet

DRAW STUD POKER-TYPE CARD GAME

The present invention is directed to card games and, more particularly, to a card game wherein a player is provided with sequential opportunities to build a winning hand.

BACKGROUND OF THE INVENTION

People have enjoyed games which combine elements of chance and skill for many years. Players typically enjoy games which are easy to learn, rapidly played and provide opportunities for high winning payouts.

Poker is also a well known game utilizing a standard deck of playing cards. Poker is played in a myriad of variations such as DRAW Poker and STUD Poker. In Poker, various combinations of cards have significance, based on both the numerical value of the cards and the suits. The basic object of Poker is for the player to achieve a five card hand having a higher Poker rank than the hands held by the player's opponents. The basic priority or rank order of winning poker hands is: Royal Flush, Straight Flush, Four of a Kind, Full House, Flush, Straight, Three of a Kind, Two Pair, One Pair and High Card(s) in Hand.

It is also been known to utilize wild cards in the game of Poker. Typically one or more types of cards from a standard playing deck are designated as wild cards, such a deuces or one-eyed Jacks. It is also known to add an extra card or cards to the deck as wild cards and these extra cards are conventionally referred to as Jokers.

One popular game of cards known as "STUD" poker provides each player with five (5) cards which form the player's hand. If the game involves a plurality of players competing against each other, the players are typically given multiple chances to increase the amount of wager necessary for other players to stay in the game. Alternatively, if the players are separately playing against a dealer, i.e. the "house", the players can try to beat the dealer or try to obtain one of a predetermined collection of winning hands. In such a game, the winning payouts for any given hand are inversely proportional to the probability of attaining that given hand.

Another type of poker game known as "DRAW" poker permits a player to make a single discard whereby one or more of the player's cards are replaced by the dealer. The number of cards that a player may discard is sometimes limited. For example, in the game of FIVE CARD DRAW, a player may be restricted to replacing only three cards per hand. Those skilled in the art will appreciate that players will tend to obtain hands with higher poker rankings in "DRAW" games than in "STUD" games. Furthermore, in order to limit the players' opportunities to increase the value of their hands in "DRAW" games, players are typically restricted to discarding only once.

While "STUD" and "DRAW" poker game s have been very popular among card players, they each have disadvantages. In casino "STUD" poker games there is very little interplay between a house dealer and a player. Furthermore, the player has absolutely no determinative input to the poker ranking of his hand. In "DRAW" poker games, a player is limited to making a single decision regarding which cards to keep based upon a strategy which is formed when the initially-dealt cards are reviewed. After that single decision, the fate of the hand's poker ranking is left to chance.

In light of the general popularity of poker-type games, yet the disadvantages described above, it is desirable to provide a card game having increased player-dealer interaction. It is also desirable to provide an easy-to-learn card game allowing a greater number of decisions, and a dynamic strategy which may change as a player builds his hand.

SUMMARY OF THE INVENTION

The various embodiments of the present invention provide opportunities to build winning hands which contain at least one of a pre-selected plurality of winning card combinations.

One embodiment of the present invention comprises a method of playing a card game wherein a player is provided with sequential opportunities to build a winning hand comprising the steps of: providing a player with an opportunity to make a wager; providing a player with a first plurality of cards wherein one of said cards is a first optional card; providing said player with the choice of keeping or discarding said first optional card; subsequently providing said player with a first replacement card if said player discarded said first optional card; providing said player with a second optional card; providing said player with the choice of keeping or discarding said second optional card; subsequently providing said player with a second replacement card if said player discarded said second optional card; and providing said player with a winning payout if said player's final hand favorably compares with a predetermined winning payout schedule.

According to an alternative embodiment, the player receives a plurality of cards one-at-a-time and is given the opportunity to keep or discard each of the cards as they are dealt.

According to a still further embodiment, a player is given an opportunity to keep or discard each of a first plurality of cards as they are sequentially dealt, and is then provided with a least one additional card which the player does not have the option of discarding.

An alternative embodiment of the present invention comprises a gaming device adapted to play one or more of the embodiments described herein. For example, the gaming device can advantageously be programmed to receive a wager and display an initial plurality of cards. One of the initially displayed cards is a first optional card. The gaming device comprises a "KEEP" button and a "DISCARD" button with which the player indicates his desire with respect to the first optional card. If the first optional card is discarded, a replacement card is provided in place thereof and a second optional card is provided. According to this embodiment, the player uses the same "KEEP" and "DISCARD" buttons to indicate whether he wishes to discard the second optional card. These steps are repeated until the player's hand is complete. At that time, a winning payout is provided if the player's hand comprises at least one of a pre-selected plurality of winning card combinations. The payout is preferably equal to the product of the amount wagered and a whole number multiple which is inversely proportional to the probability of attaining the winning card combination.

Alternative embodiments of the present invention provide a player with the option of keeping or discarding each card more than once. For example, in a five-card hand, if the player decides to discard his third card and subsequently receives a replacement card which he does not want to keep, then the player may be provided with the further option of discarding the replacement third card. The option of discarding any given card can be utilized with any of the embodiments described herein.

These and other embodiments are described in further detail below.

BRIEF DESCRIPTION OF THE FIGURE

The Figure illustrates a gaming device apparatus of one embodiment of the present invention.

DETAILED DESCRIPTION

Figure 1:
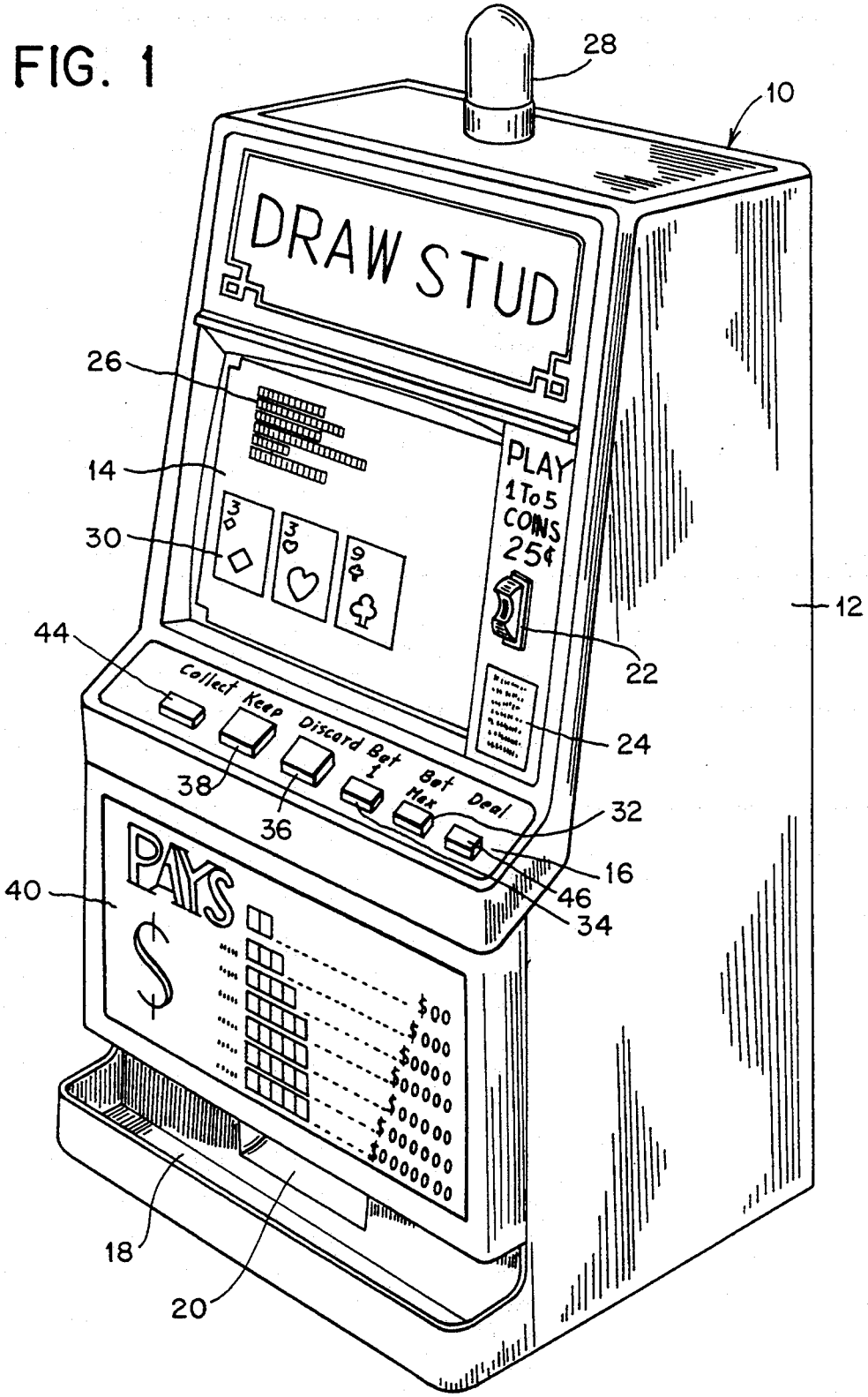

Various embodiments of the present invention combine the most exciting elements of "DRAW" poker and "STUD" poker in an easy-to-learn card game which enables a player to construct a winning hand using a dynamic strategy. As used herein, the term "dynamic strategy" is meant to indicate that a player may formulate one strategy as he builds his hand, and then may subsequently change strategies after receiving one or more additional cards.

One preferred embodiment of the present invention is illustrated in the Figure and comprises an apparatus adapted to receive a wager, display indicia of playing cards, and provide a winning payout if a winning hand is attained. The illustrated gaming device comprises a housing 12 having a front face panel which includes a video display screen 14, a button ledge 16 and a coin payout trough 18. The game is started when a player deposits coins into a coin deposit slot 22. Those skilled in the art will appreciate that some limit is usually placed on the initial wager. In the illustrated embodiment, an indication is provided on the face of the machine 10 that a player may place an initial wager of from one to five twenty-five cent coins. Also included on the front face panel of the housing 12 are game instructions 24 to instruct the player as to how to play the game and preferably written instructions 26 on the video screen 14 indicating what action is required by the player at a particular time. The illustrated housing 12 also includes a flashable light 28 mounted on the top of the housing 12. The function of the flashable light 28 is to announce a jackpot or the equivalent thereof. The use of such a flashable light 28 is deemed to be conventional and forms no specific part of this invention.

The use of video games having an appearance such as that shown in FIG. 1 is quite common. According to the present invention, included within the housing 12 are appropriate electronics and software which are pre-programmed to effect the playing of the game of this invention. The particular electronic elements utilized and programming format may be readily assembled and performed by one skilled in the art in light of the present description, therefore, further detailed explanation of the specific electronics and programming is not provided herein.

The illustrated gaming device embodiment of this invention is configured to play a poker-type game using five cards. Before play is commenced, the machine may be programmed to generate one or more messages on display screen 14. Suitable controls and detectors may also be provided for detecting coins in amounts other than the required wager, i.e. in this case other than a quarter, or for detecting bills and/or cards and for calculating the total amount of the wager.

According to the illustrated five-card embodiment of the present invention, after a player has deposited a wager in coin slot 22, three cards are displayed on display screen 14. One of the cards is preferably displayed in a particular fashion to indicate that it is the first optional card. Preferably simultaneously, "KEEP" button 38 and "DISCARD" button 36 flash to indicate that the player must decide whether to keep or discard the first optional card. If "DISCARD" button 36 is actuated, a different card is provided in its place on display screen 14. If the "KEEP" button is actuated, the displayed card is retained. In either case, after a decision has been made for the third card, a fourth card which is the second optional card is displayed in a flashing manner to indicate that the newly displayed card is the second optional card. "KEEP" button 38 and "DISCARD" button 36 again flash until the player indicates whether he wants to keep or discard the second optional card. If the player discards the second optional card, a replacement card is provided in its place.

Alternatively, he can keep the second card. In any event, after the player has indicated his choice with respect to the second card, a third optional card is displayed.

According to the illustrated embodiment of present invention, the player is only given one opportunity to discard. If a card is discarded, the apparatus assigns a new card which may not be changed by the player. In another embodiment of the present invention, a player is provided with more than one option for a given card. Thus, if a player does not wish to retain the replacement card received after discarding a card, he can discard the replacement card and receive a second replacement card. This aspect of the present invention can provide more than two opportunities to replace a given card and can also be combined with other embodiments of the game. For example, in one five-card embodiment, one or more cards are provided to a player without any options of discarding, one or more other cards are provided with a single discard option, while the player is provided with multiple opportunities to discard one or more other cards. For example, the first two cards displayed may be provided without an option, while the player may be provided with a single option for each of the third and fourth card and then provided with multiple options to discard cards which would be sequentially displayed in the fifth card position if the player does not elect to keep the original or first replacement fifth card. Those skilled in the art will appreciate that the order may also be varied without departing from the scope of the present invention. For example, the second through fourth cards may be "optional" while the first and last may be provided without an option to discard.

As stated above, in an alternative embodiment of the present invention, the first card displayed on display screen 14 is an optional card. According to this embodiment, each of the five cards displayed are "optional" cards.

According to a still further embodiment of the present invention, at least one, and preferably a plurality, of the initially displayed cards are "optional" cards and then at least one of the subsequent cards displayed is provided to the player without the option for discarding that card.

These various embodiments of the present invention can be played with any number of cards comprising the hand or from which the hand may be comprised. It will also be appreciated by those skilled in the art that though the displays on the illustrated gaming device are referred to herein as "cards", it is more typical to display indicia of cards than an actual cardboard or plastic card. While Poker rankings are preferred, alternative winning card combinations may also be employed without departing from the scope of the present invention. The various embodiments my also utilize a single deck from which the cards are selected or can employ a plurality of decks and/or wild cards. When a single deck is employed, it is most preferable that the gaming device be suitably programmed so that a player will not subsequently receive a card that he has discarded during the same hand.

The payout schedule 40 can also vary as desired but may, for example, be as follows:

| HAND | PAYS |
|---|---|
| pair of 8's or better | 1 |
| 2 pairs | 2 |
| 3 of a kind | 3 |
| straight | 4 |
| flush | 6 |
| full house | 9 |
| 4 of a kind | 50 |
| straight flush | 100 |
| royal flush | 1600 |

In addition to the buttons described above, additional buttons 32, 34, 44 can be provided to perform functions known in the art. For example, it is well known in the gaming industry to permit players to play against gaming credits which are typically displayed on a display screen. BET MAX button 32 is provided for players who wish to indicate that they want to bet the maximum amount permitted on a given hand. For players wishing to bet less than the maximum, button 34 allows the players to increment the amount wagered by a set amount, such as one unit of the devices stated denomination each time "BET 1" button 34 is depressed. When a player desires to stop playing he can depress COLLECT button 44 which will dispense currency through coin chute 22 into coin trough 18 or may otherwise credit the player as in cashless systems currently in use. DEAL button 46 is used by players to indicate that they wish to play another hand.

Those skilled in the art will appreciate that the present invention provides for dynamic strategies during a single hand. For example, if a player receives a 3 of Hearts, 8 of Hearts, and a Queen of Hearts, he may plan to seek a Flush or even a Royal Flush. However, if the player then receives a Queen of Diamonds, he may forsake his Flush strategy and keep the Queen of Diamonds in order to assure a winning payout. It will, therefore, be appreciated that embodiments of this invention require players to make multiple decisions and provide exciting opportunities for dynamic strategies.

I claim:

1. An apparatus for playing a card game wherein a player is given an opportunity to build a winning hand comprising:

means for receiving a wager;

means for indicating a winning payout schedule;

means for sequentially displaying a plurality of indicia of cards;

means for inputting a player's option for at least two of said displayed indicia of cards;

wherein said displaying means displays said first optional card indicia and said inputting means provides a player with an opportunity to keep or discard said optional card before displaying the number of card indicia in the highest winning payout on said payout schedule.

2. An apparatus according to claim 1 further comprising means for comparing the cards displayed by said displaying means with a predetermined plurality of winning card combinations and providing said player with a winning payment if said displayed cards comprise at least one of said predetermined plurality of winning card combinations.

3. An apparatus according to claim 1 wherein said inputting means comprises a DISCARD button.

4. An apparatus according to claim 3 wherein said inputting means further comprises a KEEP button.

5. An apparatus according to claim 2 wherein said displaying means displays at least two optional cards before displaying the number of cards in the highest winning payout on said payout schedule.

6. An apparatus according to claim 1 wherein said displaying means displays at least three optional cards.

7. An apparatus according to claim 1 wherein said displaying means displays at least five cards, with each of said cards having an assigned card position, and wherein said player is provided with an opportunity to keep or discard cards initially displayed in each of at least two of said positions.

8. An apparatus according to claim 1 wherein said displaying means displays at least five cards, with each of said cards having an assigned card position, and wherein said player is provided with multiple opportunities to keep or replace cards displayed in each of at least one of said card positions.

9. An apparatus according to claim 1 wherein said displaying means comprises means for limiting the appearance of any given card to a single occurrence during a single hand.

10. A method of playing a card game wherein a player is provided with a opportunity to build a winning hand comprising the steps of:

displaying a payout schedule comprising different payouts for different card hands;

sequentially displaying a plurality of indicia of playing cards to at least one player and providing said player with at least one opportunity to keep a card or have said card replaced with a replacement card prior to displaying the number of cards in the highest winning payout on said payout schedule.

11. A method according to claim 10 wherein a player is provided with a second optional card which said player may keep or have replaced, after said player has decided to keep or discard a first optional card.

12. A method according to claim 10 wherein a total of at least five cards are displayed to said player, with each of said cards having an assigned card position, and wherein said player is provided with an opportunity to keep or discard cards initially displayed in at least two of said positions.

13. A method according to claim 12 wherein a total of at least five cards are displayed to said player, with each of said cards having an assigned card position, and wherein said player is provided with an opportunity to keep or discard cards initially displayed in at least three of said positions.

14. A method according to claim 10 wherein a total of at least five cards are displayed to said player, with each of said cards having an assigned card position, and wherein said player is provided with multiple opportunities to keep or replace cards displayed in at least one of said card positions.

15. A method of playing a card game according to claim 10 further comprising the steps of:

providing a winning payout schedule;

providing a player with a first plurality of indicia of cards wherein one of said card indicia is a first optional card;

providing said player with the option of keeping or discarding said first optional card before displaying the number of cards in the highest winning payout on said payout schedule;

subsequently providing said player with a first replacement card if said player discarded said first optional card;

providing said player with an indicia of a second optional card;

providing said player with the choice of keeping or discarding said second optional card;

subsequently providing said player with a second replacement card if said player discarded said second optional card; and providing said player with a winning payout if said player's final hand favorably compares with a predetermined winning payout schedule.

16. A method of playing a card game according to claim 15 further comprising the step of providing said player with a third optional card which said player may keep or discard and subsequently providing said player with a third optional replacement card if said player discards said third optional card prior to providing said player with a winning payout.

17. A method of playing a card game according to claim 15 wherein said first plurality of cards comprises at least three cards.

18. A method of playing card game according to claim 15 wherein, after receiving at least one optional indicia of a card, a player is provided with at least one additional card which said player does not have the option of discarding.

19. An apparatus for playing a card game wherein a player is given an opportunity to build a winning hand comprising:

means for receiving a wager;

means for indicating a winning payout schedule;

means for sequentially displaying a plurality of indicia of cards;

means for inputting a player's option for at least two of said displayed indicia of cards;

wherein said displaying means displays at least one optional card in a first optional card position before displaying any cards in a second optional card position.

* * * * *